US007659860B2

(12) United States Patent
Manholm et al.

(10) Patent No.: US 7,659,860 B2
(45) Date of Patent: Feb. 9, 2010

(54) TRIPLE POLARIZED SLOT ANTENNA

(75) Inventors: Lars Manholm, Göteborg (SE); Fredrik Harrysson, Göteborg (SE)

(73) Assignee: Telefonaktiebolaget L M Ericsson (Publ), Stockholm (SE)

( * ) Notice: Subject to any disclaimer, the term of this patent is extended or adjusted under 35 U.S.C. 154(b) by 241 days.

(21) Appl. No.: 11/722,389

(22) PCT Filed: Dec. 27, 2004

(86) PCT No.: PCT/SE2004/002012

§ 371 (c)(1),
(2), (4) Date: Nov. 30, 2007

(87) PCT Pub. No.: WO2006/071140

PCT Pub. Date: Jul. 6, 2006

(65) Prior Publication Data

US 2008/0074337 A1 Mar. 27, 2008

(51) Int. Cl.
*H01Q 13/12* (2006.01)

(52) U.S. Cl. ..... 343/769

(58) Field of Classification Search ..... 343/700 MS, 343/909, 767–770

See application file for complete search history.

(56) References Cited

U.S. PATENT DOCUMENTS 3,165,743 A 1/1965 Hatkin
3,665,480 A 5/1972 Fassett
6,404,394 B1 * 6/2002 Hill ..... 343/702
6,507,320 B2 * 1/2003 Von Stein et al. ..... 343/770
6,774,867 B2 * 8/2004 Diaz et al. ..... 343/909
6,795,020 B2 * 9/2004 Sreenivas et al. ..... 343/700 MS
6,947,008 B2 * 9/2005 Tillery et al. ..... 343/824
7,026,995 B2 * 4/2006 Sreenivas et al. ..... 343/700 MS
2002/0190908 A1 12/2002 Andrews

OTHER PUBLICATIONS

Xing Lang—A Novel High Performance GPS Microstrip Antenna. —0-7803-6369-800—2000 IEEE, pp. 988 and 990. Antenna Research Associates Inc., Beltsville. MD 20705.

* cited by examiner

*Primary Examiner*—Huedung Mancuso

(57) ABSTRACT

The present invention relates to an antenna arrangement comprising a dielectric medium (2) with a first side (3) and a second side (4), with a feeding arrangement (6; 6') on the first side and at least one slot (5; 62, 63, 64, 65, 66, 67, 68, 69, 70, 71, 72, 73) in a ground plane on the second side, where the feeding arrangement comprises at least a first (13; 13'; 37; 37'), a second (14; 14'; 38; 38'), a third (15; 15'; 41; 41') and a fourth (16; 16', 42; 42') feeding conductor, each intersecting the gap of the slot (5; 62, 63, 64, 65; 66, 67, 68, 69, 70, 71, 72, 73), where each intersection constitute a feeding point (17, 18, 19, 20; 39, 40, 43, 44, 50, 51, 52, 53) for the antenna arrangement (1; 1'; 1''; 1'''). In a first mode of operation, a first constant E-field (26) that is directed across the slot is obtained. In a second mode of operation, a second E-field (28) which is directed across the slot, having a sinusoidal variation is obtained. In a third mode of operation, a third E-field (30) which is directed across the slot, having a sinusoidal variation, is obtained.

8 Claims, 4 Drawing Sheets

TRIPLE POLARIZED SLOT ANTENNA

TECHNICAL FIELD

The present invention relates to an antenna arrangement comprising a dielectric medium with a first side and a second side, with conducting surface structures formed on each of said first and second sides, and in which antenna arrangement the conducting structure on the first side is a ground plane and the conducting structure on the second side is a feeding arrangement, where there is at least one slot in the ground plane, said at least one slot constituting a gap in the ground plane, and in that the feeding arrangement comprises at least a first, a second, a third and a fourth feeding conductor, each feeding conductor intersecting the gap of said at least one slot in the ground plane, and extending across the slot in question, passing the slot by a certain distance, said distance constituting a stub, and where each intersection constitute a feeding point for the antenna arrangement.

BACKGROUND ART

The demand for wireless communication systems has grown steadily, and is still growing, and a number of technological advancement steps have been taken during this growth. In order to acquire increased system capacity for wireless systems by employing uncorrelated propagation paths, MIMO (Multiple Input Multiple Output) systems have been considered to constitute a preferred technology for improving the capacity. MIMO employs a number of separate independent signal paths, for example by means of several transmitting and receiving antennas. The desired result is to have a number of uncorrelated antenna ports for receiving as well as transmitting.

For MIMO it is desired to estimate the channel and continuously update this estimation. This updating may be performed by means of continuously transmitting so-called pilot signals in a previously known manner. The estimation of the channel results in a channel matrix. If a number of transmitting antennas Tx transmit signals, constituting a transmitted signal vector, towards a number of receiving antennas Rx, all Tx signals are summated in each one of the Rx antennas, and by means of linear combination, a received signal vector is formed. By multiplying the received signal vector with the inverted channel matrix, the channel is compensated for and the original information is acquired, i.e. if the exact channel matrix is known, it is possible to acquire the exact transmitted signal vector. The channel matrix thus acts as a coupling between the antenna ports of the Tx and Rx antennas, respectively. These matrixes are of the size M×N, where M is the number of inputs (antenna ports) of the Tx antenna and N is the number of outputs (antenna ports) of the Rx antenna. This is previously known for the skilled person in the MIMO system field.

In order for a MIMO system to function efficiently, uncorrelated, or at least essentially uncorrelated, transmitted signals are required. The meaning of the term "uncorrelated signals" in this context is that the radiation patterns are essentially orthogonal. This is made possible for one antenna if that antenna is made for receiving and transmitting in at least two orthogonal polarizations. If more than two orthogonal polarizations are to be utilized for one antenna, it is necessary that it is used in a so-called rich scattering environment having a plurality of independent propagation paths, since it otherwise is not possible to have benefit from more than two orthogonal polarizations. A rich scattering environment is considered to occur when many electromagnetic waves coincide at a single point in space. Therefore, in a rich scattering environment, more than two orthogonal polarizations can be utilized since the plurality of independent propagation paths enables all the degrees of freedom of the antenna to be utilized.

Antennas for MIMO systems may utilize spatial separation, i.e. physical separation, in order to achieve low correlation between the received signals at the antenna ports. This, however, results in big arrays that are unsuitable for e.g. hand-held terminals. One other way to achieve uncorrelated signals is by means of polarization separation, i.e. generally sending and receiving signals with orthogonal polarizations.

It has then been suggested to use three orthogonal dipoles for a MIMO antenna with three ports, but such an antenna is complicated to manufacture and requires a lot of space when used at higher frequencies, such as those used for the MIMO system (about 2 GHz). Up to six ports have been conceived, as disclosed in the published application US 2002/0190908, but the crossed dipole and the accompanying loop element is still a complicated structure that is difficult to accomplish for higher frequencies to a reasonable cost.

The objective problem that is solved by the present invention is to provide an antenna arrangement suitable for a MIMO system, which antenna arrangement is capable of sending and receiving in three essentially uncorrelated polarizations. The antenna arrangement should further be made in a thin structure to a low cost, and still be suitable for higher frequencies, such as those used in the MIMO system.

DISCLOSURE OF THE INVENTION

This objective problem is solved by means of an antenna arrangement according to the introduction, which antenna arrangement further is characterized in that the feeding points are of such a number that they constitute a number of opposite feeding point pairs and where all the feeding points of the feeding arrangement are arranged for feeding the at least one slot in transmission as well as in reception, where, in a first mode of operation, at least two pairs of opposite feeding points are fed essentially in phase with each other, resulting in a first constant E-field that is directed across the slot gap, and, in a second mode of operation, the feeding points of at least one feeding point pair are fed essentially 180° out of phase with each other, resulting in a second E-field which is directed across the slot gap, having a sinusoidal variation and, in a third mode of operation, the feeding points of at least one feeding point pair, separate from the feeding point pair of the second mode of operation, are fed essentially 180° out of phase with each other, resulting in a third E-field which is directed across the slot gap, having a sinusoidal variation, where a first imaginary line, intersecting the feeding point pair of the second mode of operation, and a second imaginary line, intersecting the feeding point pair of the third mode of operation, are essentially perpendicular to each other.

Preferred embodiments are disclosed in the dependent claims.

Several advantages are achieved by means of the present invention, for example:

- A low-cost triple polarized antenna arrangement is obtained.
- A triple polarized antenna made in planar technique is made possible, avoiding space consuming antenna arrangements.

A triple polarized antenna which is easy to manufacture is obtained.

BRIEF DESCRIPTION OF DRAWINGS

The present invention will now be described more in detail with reference to the appended drawings, where.

PREFERRED EMBODIMENTS

Figure 1A:
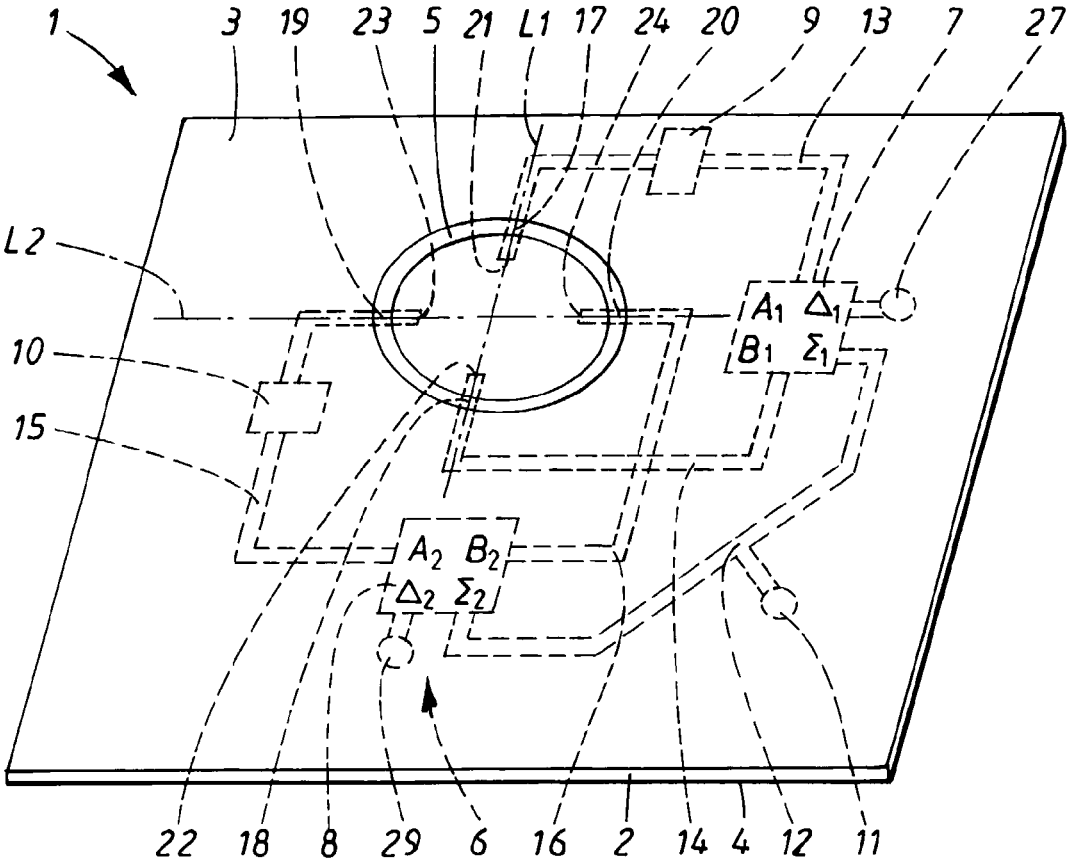
FIG. 1*a* shows a schematic perspective view of a first embodiment of the present invention.

According to the present invention, a so-called triple-mode antenna arrangement is provided. The triple-mode antenna arrangement is designed for transmitting three essentially orthogonal radiation patterns.

As shown in FIG. 1, illustrating a first embodiment of the present invention, a triple-mode antenna arrangement 1 comprises a copper-clad dielectric laminate 2, for example a Teflon-based laminate. The laminate 2 has a first copper-clad side 3 and a second copper-clad side 4. On the first copper-clad side 3, copper is removed in such a way that a ring-shaped slot 5 in the copper is provided. The slot 5 constitutes a gap in the ground plane. On the second side 4, most of the copper is removed, leaving a feeding network 6 for exciting the slot 5. The removal of the copper may be performed in many ways, the most preferred is etching. Milling or screen-printing, for example, is also conceivable.

By means of the feeding network 6, the ring-shaped slot 5 is excited in three different ways, in a first, second and third mode of operation, enabling three orthogonal radiation patterns to be transmitted. The circumferential length of the ring 5 is about 1-2 wavelengths, calculated from the centre frequency of the frequency band for which the antenna arrangement 1 is designed. The wavelength is further calculated with laminate material effects taken into account, resulting in a so-called guided wavelength.

The feeding network 6 further comprises a first 7 and a second 8 four-port 90° 3 dB hybrid junction and a first 9 and second 10 90° phase-shifter. Each four-port 90° 3 dB hybrid junction 7, 8 has four terminals, A, B, Σ and Δ. If the Δ terminal is connected to its characteristic impedance, an input signal at the Σ terminal is divided into two signals at the A and B terminal, each signal having the same amplitude with the phase at the A terminal shifted −90°. If, on the other hand, the Σ terminal is connected to its characteristic impedance, an input signal at the Δ terminal is divided into two signals at the A and B terminal, each signal having the same amplitude with the phase at the A terminal shifted +90°. The function is reciprocal.

As shown in FIG. 1, the first four-port 90° 3 dB hybrid junction 7 comprises a difference terminal $\Delta_1$, a sum terminal 71 and two signal terminals $A_1$ and $B_1$. Further, the second four-port 90° 3 dB 10 hybrid junction comprises a difference terminal $\Delta_2$, a sum terminal $\Sigma_2$ and two signal terminals $A_2$ and $B_2$. The sum terminals $\Sigma_1$ and $\Sigma_2$ are connected to a common sum signal port 11 at a sum connection point 12.

The feeding network 6 comprises conductors 13, 14, 15, 16, which conductors 13, 14, 15, 16 lead from the first 7 and second 8 90° 3 dB hybrid junctions, and are of essentially equal lengths, excluding the first 9 and second 10 phase shifters. The conductors 13, 14, 15, 16 intersect the ring-shaped slot 5 at a first 17, second 18, third 19 and fourth 20 intersection points at essentially 90° relative to the tangent of the slot 5 at the intersection points 17, 18, 19, 20. The conductors 13, 14, 15, 16 have a main direction when crossing the slot 5, which in this case means that the conductors "cross" the circle at essentially right angles.

The four intersection points 17, 18, 19, 20 which function as feeding points and will be called feeding points in the following, are succeeding, forming a first 17, second 18, third 19 and fourth 20 feeding point, and are separated by essentially 90° along the circumference of an imagined circle (not shown) in the centre of the ring-shaped slot 5 which forms the mean circumference of the slot 5. The succeeding feeding points 17, 18, 19, 20 are then positioned in such a way that the first 17 and second 18 feeding points are opposite each other and the third 19 and fourth 20 feeding points are opposite each other, the clockwise order of the succeeding feeding points being the first 17, the fourth 20, the second 18 and the third 19.

The first 17 and second 18 feeding points constitute a first feeding point pair and the third 19 and fourth 20 feeding points constitute a second feeding point pair. A first imaginary line L1, intersecting the first feeding point pair, and a second imaginary line L2, intersecting the second feeding point pair, are essentially perpendicular to each other.

The signal terminal $A_1$ is connected to the first feeding point 17 via the first phase shifter 9, and the signal terminal $A_2$ is connected to the third feeding point 19 via the second phase shifter 10. Further, the signal terminal $B_1$ is connected to the second feeding point 18 and the signal terminal $B_2$ is connected to the fourth feeding point 20.

Furthermore, as shown in FIG. 1, the conductors 13, 14, 15, 16 intersect the slot 5 from the outside, and continue inwards towards the centre of the slot 5, passing the respective feeding point 17, 18, 19, 20, a certain distance, each one forming a so-called stub 21, 22, 23, 24.

For the first mode of operation, the sum signal port 11 is fed with a signal to the sum connection point 12, which signal is divided equally, and further fed in the same phase to the respective sum port $\Sigma_1$ and $\Sigma_2$ of the 90° 3 dB hybrid junctions 7, 8. The 90° 3 dB hybrid junctions 7, 8 then divide the respective input signal in equal portions, which are output at the respective signal terminal $A_1$ and $B_1$ and $A_2$ and $B_2$, respectively, with the signals at the terminals $A_1$ and $A_2$ shifted −90°. The signals from $A_1$ and $A_2$ are fed through the respective 90° phase shifter 9, 10, which may be a discrete component or an adjustment of the conductor length corresponding to 90°. This means that after the respective phase shifter 9, 10, the signal from the terminals $A_1$ and $A_2$ are shifted +90°, resulting in a total phase shift of −90°+90°=0°.

Figure 1B:
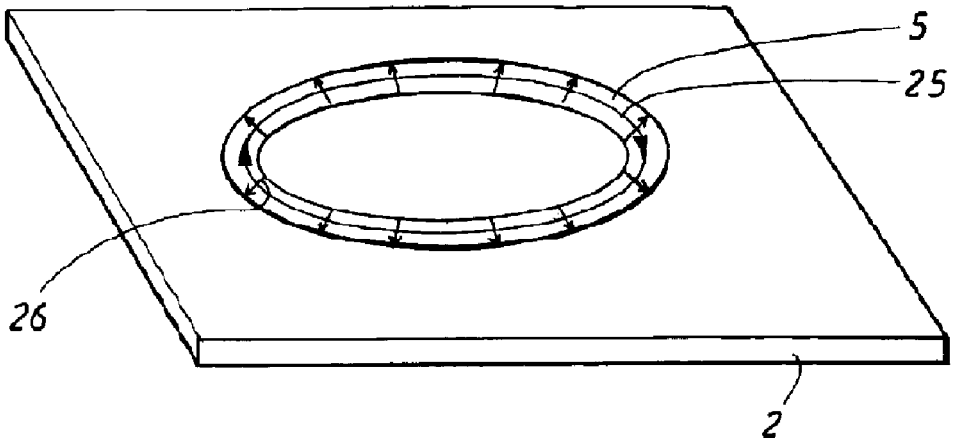
FIG. 1*b* shows a schematic perspective view illustrating certain field properties according to the present invention.

Also with reference to FIG. 1*b*, as the outputs from the signal terminals $B_1$ and $B_2$ are not phase shifted at all, this results in the ring-shaped slot 5 being fed with equal amplitude and phase at the feeding points 17, 18, 19, 20, which results in a constant magnetic current loop 25, which may be regarded as a TEM-mode in a coaxial conductor. This magnetic current 25 corresponds to a first E-field 26 that is constant and directed radially in the slot 5, in FIG. 1*b* shown with a number of radially directed arrows.

With reference to FIG. 1*a*, in the second mode of operation, a signal is fed to the first difference terminal $\Delta_1$ of the first 90°

3 dB hybrid junction 7 via a first difference port 27. The first 90° 3 dB hybrid junction 7 then divide the input signal in equal portions, which are output at the respective signal terminal $A_1$ and $B_1$, with the signal at the terminal $A_1$ shifted +90°. The signal from $A_1$ is then fed through the first 90° phase shifter 9. This means that after the first phase shifter, the signal from the terminal $A_1$ is shifted +90°, resulting in a total phase shift of 90°+90°=180°.

Figure 1C:
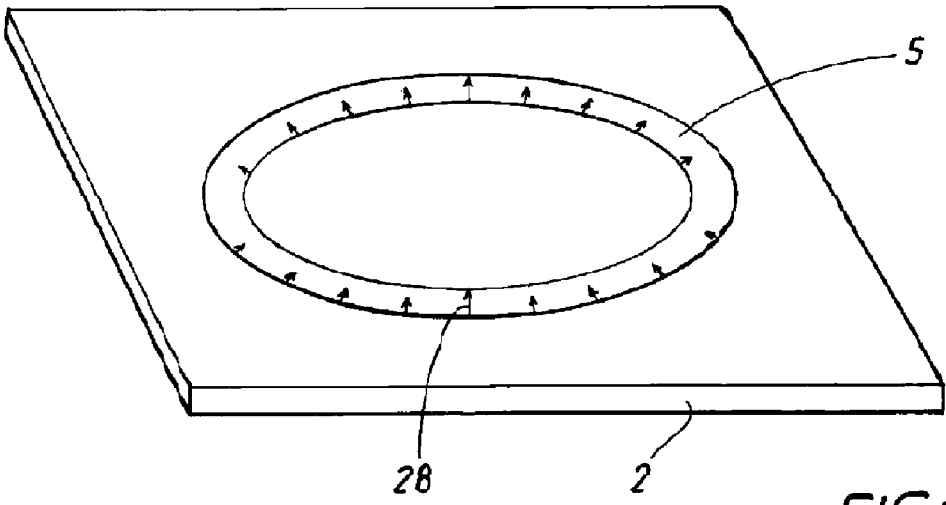
FIG. 1*c* shows a schematic perspective view illustrating certain field properties according to the present invention.
Figure 1D:
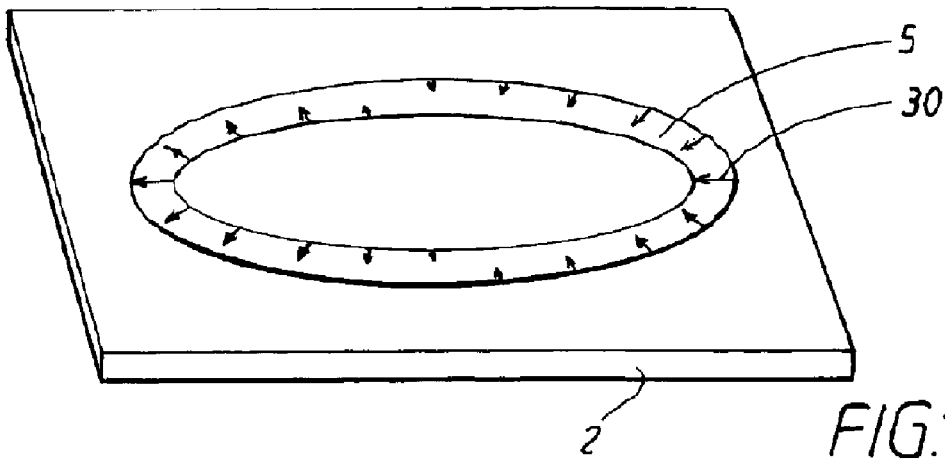
FIG. 1*d* shows a schematic perspective view illustrating certain field properties according to the present invention.

Also with reference to FIG. 1*c*, as the outputs from the signal terminal $B_1$ are not phase shifted at all, this results in the ring-shaped slot 5 being fed with equal amplitude, but with a phase difference of 180° at the respective feeding points 17, 18. As the conductors 13, 14, which intersect the ring-shaped slot 5, intersect the slot from opposite directions, the resulting electric fields co-operate, which results in a second E-field 28 in the ring-shaped slot 5, having a sinusoidal variation, directed radially in the ring-shaped slot 5 in the plane of the substrate 2. The E-field is shown in FIG. 1*c* as a number of arrows having a length that corresponds to the strength of the E-field, where the arrows indicate an instantaneous E-field distribution as it varies harmonically over time. This mode of operation corresponds to a $TE_{11}$-mode in a coaxial conductor.

With reference to FIG. 1*a*, the third mode of operation corresponds to the second mode of operation, but here a signal is fed to the second difference terminal $\Delta_2$ of the second 90° 3 dB hybrid junction 8 via a second difference port 29. Also with reference to FIG. 1*d*, this results in a third E-field 30 in the ring-shaped slot 5, having a sinusoidal variation, directed radially in the slot 5 in the plane of the substrate 2. This mode of operation also corresponds to a $TE_{11}$-mode in a coaxial conductor, turned 90° with respect to the $TE_{11}$-mode of the second mode of operation. Using the same reference direction for the fields, if the second E-field 28 varies with sine, the third E-field 30 varies with cosine. This means that the third E-field 30 further is perpendicular to the second E-field 28.

As a conclusion, the slot is now excited in three different ways, thus acquiring three different modes with a first, second and third E-field, constituting aperture fields which all ideally are orthogonal to each other.

The corresponding radiation patterns are also orthogonal, and the correlation equals zero, where the correlation p may be written as $$\rho = \frac{\oint_{\Omega} \vec{E}_1(\Omega)\vec{E}_2^*(\Omega)d\Omega}{\sqrt{\oint_{\Omega}\left|\vec{E}_1(\Omega)\right|^2 d\Omega \oint_{\Omega}\left|\vec{E}_2(\Omega)\right|^2 d\Omega}}$$

In the equation above, Ω represents a surface and the symbol * means that it is a complex conjugate. For the integration of the radiation pattern, Ω represents a closed surface comprising all space angels, and when this integration equals zero, there is no correlation between the radiation patterns, i.e. the radiation patterns are orthogonal to each other. The denominator is an effect normalization term.

When determining that the radiation patterns are orthogonal, it is possible to use the aperture fields. When considering the aperture fields, Ω represents an aperture surface. The aperture fields are orthogonal since the integration of a constant (the first mode) times a sinusoidal variation (second or third mode) over one period equals zero. Further, the integration of two orthogonal sinusoidal variations, sine*cosine, (the second and third mode) over one period also equals zero. As these fields 26, 28, 30 are orthogonal at the aperture of the antenna arrangement 1 and correspond to aperture currents (not shown) of the antenna 1, which aperture currents then also are orthogonal, the far-field also comprises orthogonal field vectors, as known to those skilled in the art.

Having three, at least essentially, orthogonal radiation patterns is very desirable, since this enables uncorrelated parallel channels, i.e. the rows in the channel matrix may be independent. This in turn means that the present invention is applicable for the MIMO system.

By means of superposition, all modes of operation may be operating at the same time, thus allowing the triple-mode antenna arrangement to transmit three essentially orthogonal radiation patterns.

The actual implementation of the feed network 6 is not important, but may vary in ways which are obvious for the skilled person. The important feature of the present invention according to the first embodiment is that the slot 5 is fed in three modes of operation, where the first mode of operation results in that a radial E-field is acquired at the slot 5. The other modes of operation result in that two E-fields which have sine variations of the field strength are acquired at the slot 5, where one of these E-fields is rotated 90° with respect to the other. This function is not limited by the design of the feeding network 6 or how the aperture feeding points 17, 18, 19, 20 are conceived. This is illustrated by means of two alternative exemplary embodiments with reference to FIGS. 2, 3 and 4.

Figure 2:
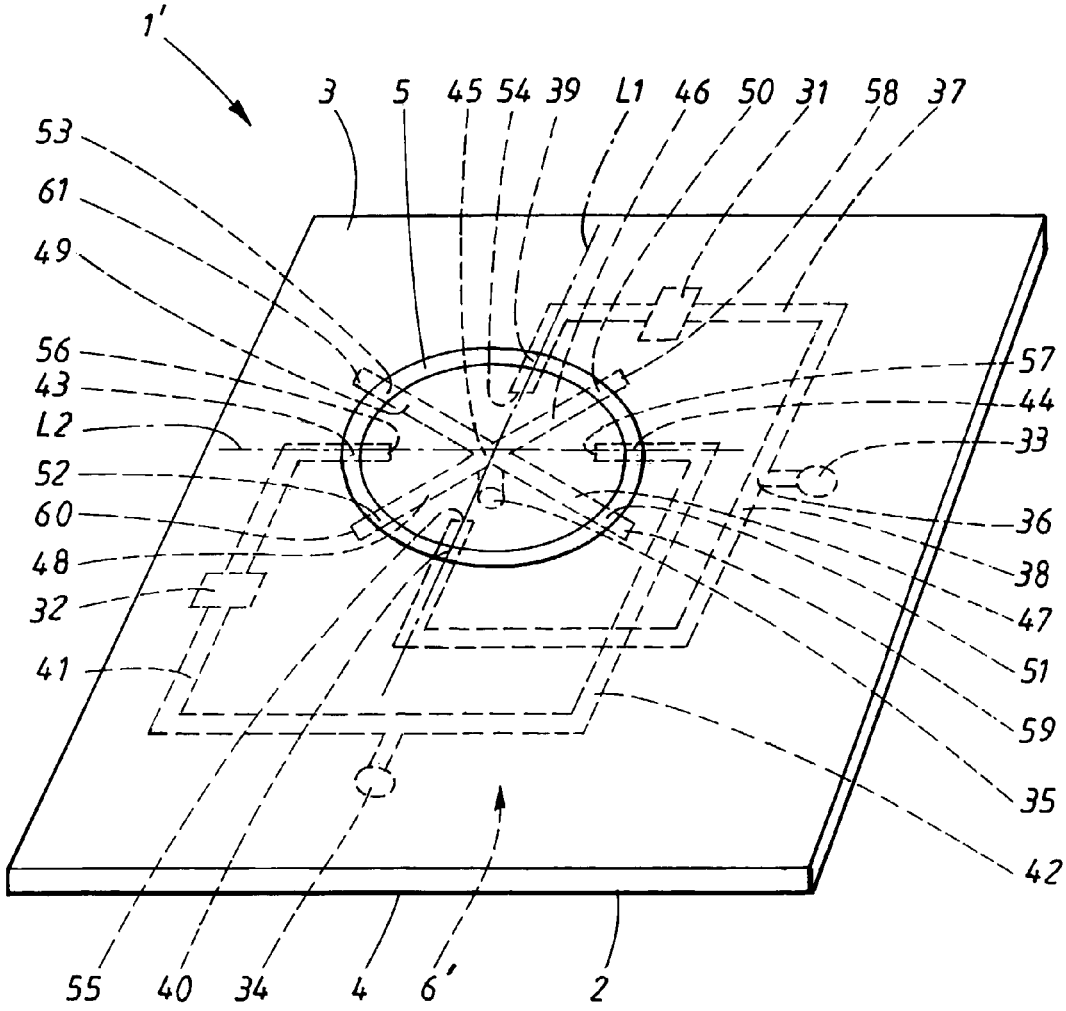
FIG. 2 shows a schematic perspective view of a second embodiment of the present invention.

As shown in FIG. 2, illustrating a second embodiment of the present invention, a triple-mode antenna arrangement 1' comprises a copper-clad dielectric laminate 2 similar to the one described with reference to FIG. 1. The laminate 2 thus comprises a first copper-clad side 3 and a second copper-clad side 4. On the first copper-clad side 3, copper is removed in such a way that a ring-shaped slot 5 in the copper is provided. On the second side, most of the copper is removed, leaving a feeding network 6' for exciting the slot 5.

Here, the feeding network comprises no 90° 3 dB hybrid junctions but a first 31 and second 32 180° phase-shifter. As shown in FIG. 2, the antenna arrangement 1' comprises a first difference port 33, a second difference port 34 and a sum port 35, where, on one hand, the sum port 35 and, on the other hand, the difference ports 33, 34 constitute separate feeds for the ring-shaped slot 5.

At the first difference port 33, there is a connection point 36, where an input signal first is divided equally and then fed in a first 37 and second 38 branch in the same phase. The first branch 37 is fed through the first 180° phase-shifter 31. This means that after the first 180° phase shifter, the signal in the first branch 37 is shifted 180°. The conductors in the first 37 and second 38 branches are of equal lengths excluding the first 180° phase shifter, and intersect the ring-shaped slot 5 at two intersection points 39, 40, intersecting the slot 5 at essentially 90° relative to the tangent of the ring-shaped slot 5 at the intersection points 39, 40. These two intersection points 39, 40, which function as feeding points, are separated with essentially 180° around the ring-shaped slot 5, i.e. the branches 37, 38 intersect the slot essentially opposite to each other and are fed with a phase difference of 180°.

At the second difference port 34 there is a similar arrangement with a first 41 and second 42 branch, where the first branch 41 of the second difference port 34 is fed through the second 180° phase-shifter 32. Also, the conductors in the first 41 and second 42 branches are of equal lengths excluding the second 180° phase shifter 32, and intersect the ring-shaped slot 5 at two locations 43, 44, intersecting the slot at essentially 90° relative to the tangent of the ring-shaped slot at the intersection points 43, 44.

The four intersection points 39, 40, 43, 44 which function as feeding points and will be called feeding points in the following, are succeeding, forming a first 39, second 40, third 43 and fourth 44 feeding point and are separated by essentially 90° along the circumference of an imagined circle (not shown) in the centre of the ring-shaped slot 5 which forms the mean circumference of the slot 5. The succeeding feeding points 39, 40, 43, 44 are then positioned in such a way that the first 39 and second 40 feeding points are opposite each other and the third 43 and fourth 44 feeding points are opposite each other, the clockwise order of the succeeding feeding points being the first 39, the fourth 44, the second 40 and the third 43.

The first 39 and second 40 feeding points constitute a first feeding point pair and the third 43 and fourth 44 feeding points constitute a second feeding point pair. A first imaginary line L1, intersecting the first feeding point pair, and a second imaginary line L2, intersecting the second feeding point pair, are essentially perpendicular to each other.

At the sum terminal 35 there is a connection point 45, where an input signal first is divided equally into four parts and then fed in a first 46, second 47, third 48 and fourth 49 sum branch in the same phase. These four sum branches 46, 47, 48, 49, which are of the same length, intersect the ring-shaped slot 5 at four locations 50, 51, 52 53, intersecting the slot at essentially 90° relative to the tangent of the ring-shaped slot 5 at the intersection points 50, 51, 52 53.

These four latter intersection points 50, 51, 52 53 which function as feeding points and will be called feeding points in the following, are succeeding, forming a fifth 50, sixth 51, seventh 52 and eighth 53 feeding point and are separated by essentially 90° along the circumference of an imagined circle (not shown) in the centre of the ring-shaped slot 5, which imagined circle forms the mean circumference of the slot 5. The succeeding feeding points 50, 51, 52 53 are then positioned in such a way that the fifth 50 and seventh 52 feeding points are opposite each other and the second sixth 51 and eighth 53 feeding points are opposite each other, the clockwise order of the succeeding feeding points being the fifth 50, sixth 51, seventh 52 and eighth 53.

The four feeding points 39, 40; 43, 44 of the first 33 and second 34 difference ports on one hand, and the four feeding points 50, 51, 52, 53 of the sum port 35, on the other hand, intersect the slot 5 with a mutual separation of essentially 45° along the imagined circle, resulting in that the slot is fed at feeding points 39, 40; 43, 44; 50, 51, 52, 53 which are separated essentially 45°, i.e. evenly distributed around the ring-shaped slot 5.

As shown in FIG. 2, the slot 5 is fed by conductors 37, 38; 41, 42 from the first 33 and second 34 difference port, which conductors 37, 38; 41, 42 intersect the slot 5 from the outside and continues inwards towards the centre of the slot a certain distance, each one forming a so-called stub 54, 55; 56, 57. The slot 5 is further fed by conductors 46, 47, 48, 49 from the sum port 35, which conductors 46, 47, 48, 49 intersect the slot 5 from the inside and continues outwards a certain distance, each one forming a stub 58, 59, 60, 61.

In the first mode of operation, a sum signal is fed to the sum connection point 45, which signal first is divided into four equal parts and further fed in the same phase to the respective feeding point 50, 51, 52, 53, resulting in that the ring-shaped slot 5 is fed with equal amplitude and phase, which, with reference also to FIG. 1*b*, in turn results in a constant magnetic current loop, which may be regarded as the TEM-mode in a coaxial conductor. This magnetic current corresponds to a first constant E-field 26 that is constant and directed radially in the slot.

With reference to FIG. 2, in the second mode of operation, a signal is fed to the first difference port 33, where it is divided into the first and second branch 37, 38 of the first difference port 33. The signal in the first branch 37 is fed through the first 180° phase shifter 31. Since the signal in the second branch 38 is not phase shifted, this results in the ring-shaped slot 5 being fed with equal amplitude but with a phase difference of 180°. As the conductors 37, 38 intersecting the ring-shaped slot 5 intersect the slot 5 from opposite directions, the resulting electric fields co-operate, which, with reference also to FIG. 1*b*, results in a second E-field 28 in the ring-shaped slot 5, having a sinusoidal variation, directed radially in the ring-shaped slot 5 in the plane of the substrate 2. This mode of operation corresponds to a $TE_{11}$-mode in a coaxial conductor.

With reference to FIG. 2, the third mode of operation corresponds to the second mode of operation, but here a signal is fed to the second difference port 34, resulting in a third E-field 30 in the ring-shaped slot 5, having a sinusoidal variation, directed radially in the slot 5 in the plane of the substrate 2. This mode of operation also corresponds to a $TE_{11}$-mode in a coaxial conductor, turned 90° with respect to the $TE_{11}$-mode of the second mode of operation. Using the same reference direction for the fields, if the second E-field 28 varies with sine, the third E-field 30 varies with cosine. This means that the third E-field 30 further is perpendicular to the second E-field 28.

As a conclusion, there are now three orthogonal radiation patterns in the same manner as for the first embodiment.

By means of superposition, all modes of operation may be operating at the same time as for the triple-mode antenna arrangement 1 according to FIG. 1*a*, thus allowing also the triple-mode antenna arrangement to transmit three essentially orthogonal radiation patterns.

Figure 3:
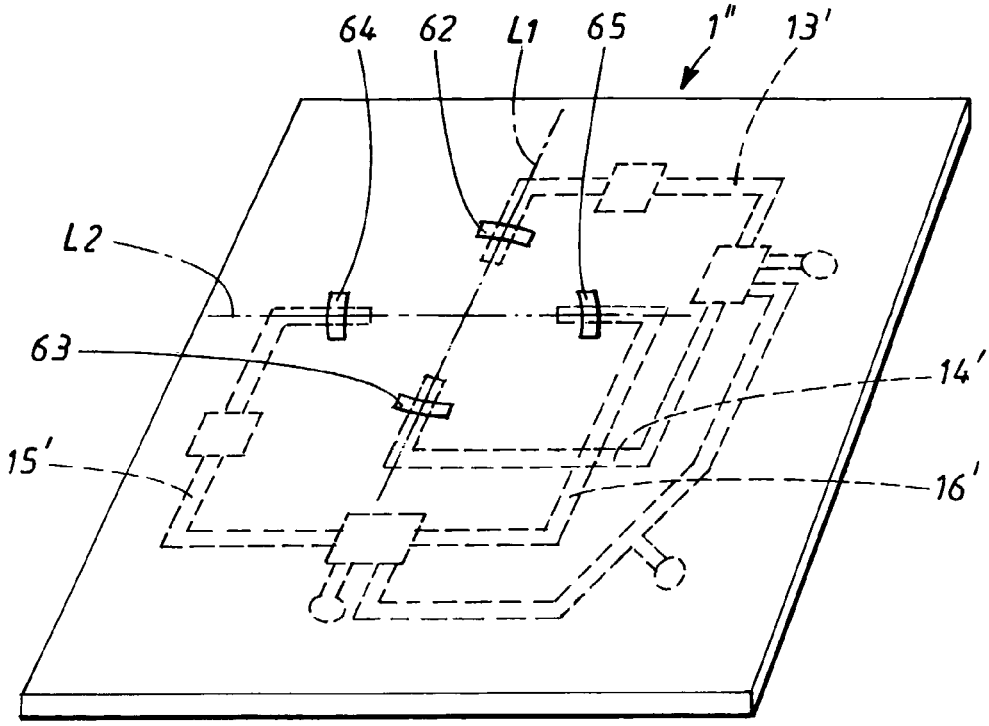
FIG. 3 shows a schematic perspective view of a third embodiment of the present invention.

The ring-shaped slot may be divided into discrete slots with appropriate length, which slots are not connected to each other. The embodiment according to FIG. 3 shows an antenna arrangement 1" which employs the same feeding arrangement as used for the embodiment according to FIG. 1*a*, and where all functions are equivalent to those of FIG. 1*a*. Here, a first 62, a second 63, a third 64 and a fourth 65 discrete slot is employed, one for each intersecting conductor 13', 14', 15', 16'.

Figure 4:
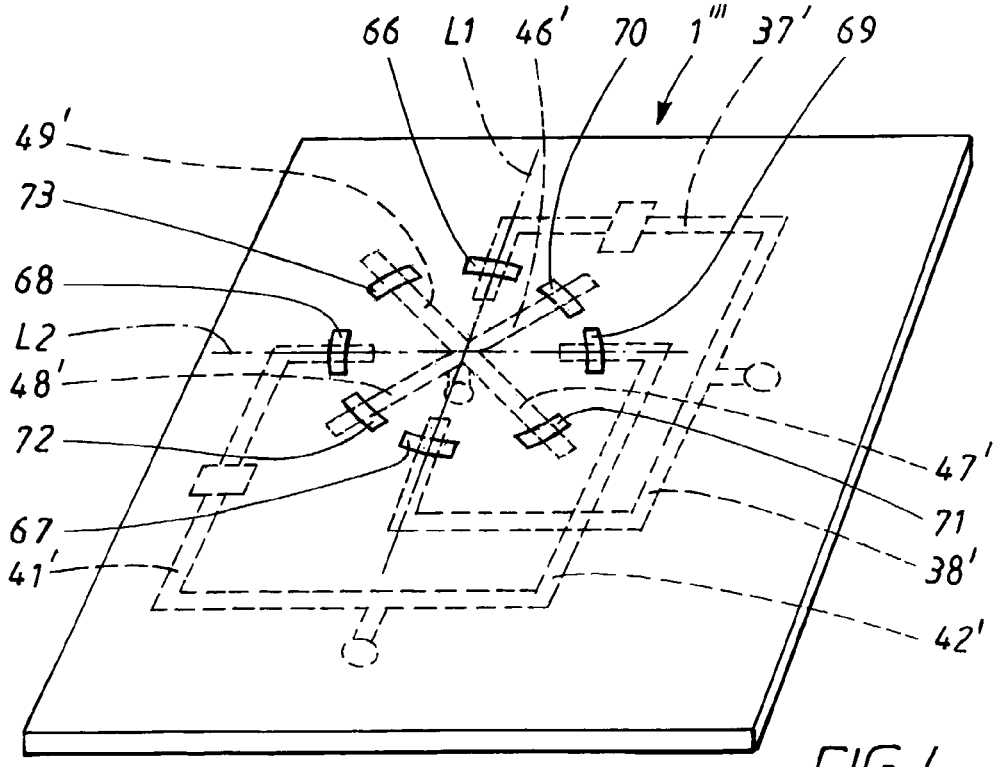
FIG. 4 shows a schematic perspective view of a fourth embodiment of the present invention.

The embodiment shown in FIG. 4 shows an antenna arrangement 1'" which employs the same feeding arrangement as used for the embodiment according to FIG. 2, and all functions are equivalent to those of FIG. 2. Here, a first 66, a second 67, a third 68, a fourth 69, a fifth 70, a sixth 71, a seventh 72 and an eighth 73 slot is employed, one for each intersecting conductor 37', 38'; 41', 42'; 46', 47', 48', 49'.

Due to reciprocity, for the transmitting properties of all the triple-mode antenna arrangements 1, 1', 1", 1'" described, there are corresponding equal receiving properties, as known to those skilled in the art, allowing the triple-mode antenna arrangement to both send and receive in three essentially uncorrelated modes of operation.

The invention is not limited to the embodiments described above, which only should be regarded as examples of the present invention, but may vary freely within the scope of the appended claims.

Other types of carrier arrangements may be conceivable instead of the laminate described. For example, different types of foam with thin conducting foils made of, for example, copper, placed on each side may be used. The conducting parts may be made in other appropriate conducting material, for example aluminum, silver or gold. The conducting parts may further be in the form of thin foils which are separated by air only, held in place by means of appropriate retainers (not shown). The conducting parts constitute conducting surface structures.

Other slot structures may also be conceivable, for example square or octagonal.

The feed network may further be implemented in many different ways, which ways are obvious for the person skilled in the art. The slot or slots may be fed in such a way that other mutually orthogonal polarizations may be obtained, for example right-hand circular polarization and/or left-hand circular polarization.

The invention claimed is:

1. An antenna arrangement comprising a dielectric medium with a first side and a second side, with conducting surface structures formed on each of said first and second sides, and in which antenna arrangement the conducting structure on the first side is a ground plane and the conducting structure on the second side is a feeding arrangement, where there is at least one slot in the ground plane, said at least one slot constituting a gap in the ground plane, where the feeding arrangement comprises at least a first, a second, a third and a fourth feeding conductor, each feeding conductor intersecting the gap of said at least one slot in the ground plane, and extending across the slot in question, passing the slot by a certain distance, said distance constituting a stub, and where each intersection constitute a feeding point for the antenna arrangement, characterized in that the feeding points are of such a number that they constitute a number of opposite feeding point pairs and where all the feeding points of the feeding arrangement are arranged for feeding the at least one slot in transmission as well as in reception, where, in a first mode of operation, at least two pairs of opposite feeding points are fed essentially in phase with each other, resulting in a first constant E-field that is directed across the slot gap, and, in a second mode of operation, the feeding points of at least one feeding point pair are fed essentially 180° out of phase with each other, resulting in a second E-field which is directed across the slot gap, having a sinusoidal variation and, in a third mode of operation, the feeding points of at least one feeding point pair, separate from the feeding point pair of the second mode of operation, are fed essentially 180° out of phase with each other, resulting in a third E-field which is directed across the slot gap, having a sinusoidal variation, where a first imaginary line, intersecting the feeding point pair of the second mode of operation, and a second imaginary line, intersecting the feeding point pair of the third mode of operation, are essentially perpendicular to each other.

2. The antenna arrangement according to claim 1, characterized in that the three modes of operation may operate at the same time.

3. The antenna arrangement according to claim 1, characterized in that all feeding conductors are of equal length.

4. The antenna arrangement according to claim 1, characterized in that the feeding arrangement further comprises a first and a second four-port 90° 3 dB hybrid junction and a first and second 90° phase-shifter, where the first four-port 90° 3 dB hybrid junction comprises a difference terminal $\Delta_1$, a sum terminal $\Sigma_1$ and two signal terminals $A_1$ and $B_1$, and the second four-port 90° 3 dB hybrid junction comprises a difference terminal $\Delta_2$, a sum terminal $\Sigma_2$ and two signal terminals $A_2$ and $B_2$, where the sum terminals $\Sigma_1$ and $\Sigma_2$ are connected to a common sum signal at a sum connection point, where furthermore each one of the signal terminals $A_1$, $B_1$, $A_2$, $B_2$ are connected to a feeding conductor leading to a feeding point in such a way that a first and a second feeding point are fed from the signal terminals $A_1$ and $B_1$, respectively, which first and a second feeding points are opposite to each other and are the feeding points of the first mode of operation, and that a third and fourth feeding point are fed from the signal terminals $A_2$ and $B_2$, respectively, which third and fourth feeding points are opposite to each other and are the feeding points of the second mode of operation, and where the first, second, third and fourth feeding points are the feeding points of the first mode of operation.

5. The antenna arrangement according to claim 1, characterized in that the feeding arrangement comprises a first and second 180° phase-shifter and a first difference terminal port, a second difference port and a sum port, where each difference port has two branches, where each branch constitutes a feeding conductor leading to a corresponding feeding point in such a way that the first branch of the first difference port is connected to a first feeding point , the second branch of the first difference port is connected to a second feeding point, the first branch of the second difference port is connected to a third feeding point and the second branch of the second difference port is connected to a fourth feeding point, where said first and second feeding points are opposite to each other and are the feeding points of the second mode of operation, and said third and fourth feeding points are opposite to each other and are the feeding points of the third mode of operation, and where furthermore the sum port has first, second, third and fourth sum branches, the first sum branch being connected to a fifth feeding point, the second sum branch being connected to a sixth feeding point, the third sum branch being connected to a seventh feeding point and the fourth sum branch being connected to an eighth feeding point, where the fifth and seventh feeding points are opposite to each other and where the sixth and eighth feeding points are opposite to each other, the fifth, sixth, seventh and eighth feeding points being the feeding points of the first mode of operation.

6. The antenna arrangement according to claim 1, characterized in that the at least one slot is in the form of discrete slots in the ground plane, one slot for each feeding point.

7. The antenna arrangement according to claim 1, characterized in that the at least one slot is in the form of a continuous, essentially ring-shaped slot, having a mean circumference along which the feeding points are evenly distributed.

8. The antenna arrangement according to claim 6, characterized in that each conductor crosses the slot at essentially 90° relative to the tangent of said mean circumference.

* * * * *